US010422564B2

(12) United States Patent
Christensen et al.

(10) Patent No.: US 10,422,564 B2
(45) Date of Patent: Sep. 24, 2019

(54) APPARATUS AND METHODS FOR CONSTRUCTING ICE STRUCTURES

(71) Applicant: Ice Castles, LLC, American Fork, UT (US)

(72) Inventors: Brent Christensen, Alpine, UT (US); Brandon Christensen, Provo, UT (US)

(73) Assignee: Ice Castles, LLC, American Fork, UT (US)

( * ) Notice: Subject to any disclaimer, the term of this patent is extended or adjusted under 35 U.S.C. 154(b) by 250 days.

(21) Appl. No.: 15/450,469

(22) Filed: Mar. 6, 2017

(65) Prior Publication Data

US 2018/0252454 A1 Sep. 6, 2018

(51) Int. Cl.

| | |
|---|---|
| ***F25C 1/045*** | (2018.01) |
| ***F25C 5/08*** | (2006.01) |
| ***F25C 1/08*** | (2006.01) |
| ***F25C 1/22*** | (2018.01) |

(52) U.S. Cl.

CPC ..... *F25C 1/045* (2013.01); *F25C 1/08* (2013.01); *F25C 1/22* (2013.01); *F25C 5/08* (2013.01)

(58) Field of Classification Search

CPC .... F25C 1/045; F25C 1/06; F25C 1/04; F25C 1/22; F25C 1/24; F25C 1/243; F25C 1/246; F25C 5/08; F25C 5/185; F25C 2400/06; F25C 1/08; F25C 5/02; F25C 5/10; A61B 5/150351; B01F 9/002; B01F 11/0037; B01L 3/14; B01L 3/50; B01L 3/5025; B01L 9/06; B01L 9/523; B01L 9/54; C12M 23/08

See application file for complete search history.

(56) References Cited

U.S. PATENT DOCUMENTS

| | | | | | |
|---|---|---|---|---|---|
| 932,329 | A * | 8/1909 | Rogers | F25C 1/24 | 62/344 |
| 1,742,122 | A * | 12/1929 | Bentley | F25C 1/22 | 220/23.4 |
| 1,907,502 | A * | 5/1933 | Chilton | F25C 1/24 | 249/120 |
| 1,952,729 | A * | 3/1934 | Rawlings | F25C 1/24 | 249/120 |

(Continued)

FOREIGN PATENT DOCUMENTS

| | | | | |
|---|---|---|---|---|
| DE | 102007038005 A1 * | 2/2009 | F25C 1/24 | |
| FR | 801824 A * | 8/1936 | F25C 1/06 | |

(Continued)

OTHER PUBLICATIONS

Vincent, S. (Jan. 4, 2015). Frozen fingers. Retrieved Jun. 14, 2019, from https://scvincent.com/2015/01/04/frozen-fingers-2/ (Year: 2015).*

*Primary Examiner* — Cassey D Bauer

*Assistant Examiner* — Miguel A Diaz

(74) *Attorney, Agent, or Firm* — Kirton McConkie; Brian Tucker

(57) ABSTRACT

Apparatus and methods for constructing ice structures are provided. An apparatus for construction of a structure from ice may include multiple tubes. Each of the tubes may be disposed in an upright position. Each of the tubes may have a constant inner diameter and/or a closed bottom. The tubes may be disposed within a frame for transport of the tubes.

20 Claims, 7 Drawing Sheets

(56) References Cited

U.S. PATENT DOCUMENTS 2,023,923 A * 12/1935 Harbordt ..... F25C 1/246 249/71
2,113,359 A * 4/1938 Stebbins ..... F25C 1/06 248/137
2,133,521 A * 10/1938 Wussow ..... F25C 1/06 241/DIG. 17
2,166,560 A * 7/1939 Schmelzer ..... F25C 1/24 249/120
RE21,249 E * 10/1939 Uline ..... F25C 1/22 220/620
2,243,363 A * 5/1941 Thomas ..... A23G 9/221 249/120
2,536,217 A * 1/1951 Pownall ..... F25C 1/06 62/1
2,704,928 A * 3/1955 Curry ..... F25C 1/24 165/133
2,741,103 A * 4/1956 Cummins ..... F25C 1/24 249/66.1
2,768,507 A * 10/1956 Hoen ..... F25C 1/06 62/188
3,274,794 A * 9/1966 Wilbushewich ..... F25C 1/06 62/349
3,565,389 A * 2/1971 Price ..... F25C 1/22 249/121
3,595,086 A * 7/1971 Bonnet ..... A61B 5/15003 73/864.01
4,099,946 A * 7/1978 Alexander ..... F25C 1/06 62/73
4,217,762 A * 8/1980 Sakamoto ..... F25C 1/04 62/132
4,602,489 A * 7/1986 Hara ..... F25C 1/045 62/320
4,910,976 A * 3/1990 Drummond, III ..... F25C 1/22 62/1
5,324,483 A * 6/1994 Cody ..... B01J 19/0046 422/534
5,520,010 A * 5/1996 Altman ..... A23L 3/364 100/195
5,714,127 A * 2/1998 DeWitt ..... B01J 19/0046 422/130
6,209,849 B1 * 4/2001 Dickmeyer ..... F25C 1/243 249/120
6,345,802 B2 * 2/2002 Moore ..... F25C 1/22 249/117
6,508,075 B1 * 1/2003 Shipley ..... F25C 1/06 62/347
D492,600 S * 7/2004 Moore ..... D9/503
8,511,042 B2 * 8/2013 Christensen ..... F25C 1/00 52/750
9,776,188 B1 * 10/2017 Kamees ..... B01L 9/06
2001/0007345 A1 * 7/2001 Moore ..... F25C 1/22 249/119
2001/0025495 A1 * 10/2001 Newman ..... A23L 3/362 62/63
2003/0034317 A1 * 2/2003 Lafond ..... B01L 9/06 211/74
2004/0075038 A1 * 4/2004 Hang ..... F25C 1/243 249/127
2005/0161414 A1 * 7/2005 Wescott, III ..... B01L 9/06 211/74
2007/0014693 A1 * 1/2007 Kantrowitz ..... B01L 3/5453 422/400
2010/0251733 A1 * 10/2010 Kim ..... F25C 1/06 62/73
2011/0198345 A1 * 8/2011 Feilders ..... B01L 7/00 219/702
2012/0177446 A1 * 7/2012 Christensen ..... F25C 1/00 405/217
2012/0277906 A1 * 11/2012 Fassberg ..... A23G 9/045 700/244
2013/0116597 A1 * 5/2013 Rudge ..... A61B 5/150358 600/575
2014/0008249 A1 * 1/2014 Muller ..... B65D 85/00 206/139
2017/0043346 A1 * 2/2017 Welch ..... A61B 5/15
2017/0198957 A1 * 7/2017 Barrett ..... F25C 1/24
2017/0282185 A1 * 10/2017 Kamees ..... B01L 9/06
2018/0017303 A1 * 1/2018 Hsu ..... F25C 1/04
2018/0178219 A1 * 6/2018 Bazin ..... B01L 9/06
2018/0202699 A1 * 7/2018 Migishima ..... F25C 1/06
2018/0257088 A1 * 9/2018 Ritter ..... B03C 1/0332
2018/0283759 A1 * 10/2018 Bess ..... F25C 1/24
2018/0361388 A1 * 12/2018 Welch ..... A61B 5/15

FOREIGN PATENT DOCUMENTS

WO WO-03078907 A1 * 9/2003 ..... F25C 1/06
WO WO-2011000027 A1 * 1/2011 ..... F25C 1/06

* cited by examiner

APPARATUS AND METHODS FOR CONSTRUCTING ICE STRUCTURES

CROSS-REFERENCE TO RELATED APPLICATIONS

N/A

BACKGROUND

In low-temperature environments, structures made out of ice or snow are common for a variety of purposes. Structures such as snow caves and igloos have long been used for purposes of shelter from the cold. More recently, ice structures have become popular for destination and/or novelty lodging (e.g. ice hotels and ice palaces) as well as for decorative and artistic purposes. Such structures are formed by cutting or carving blocks out of ice or snow and then stacking or otherwise placing the blocks to form the structure. An alternative method is to make a large pile of snow and to carve the structure out of the pile, as with a snow cave. All such structures are limited in their artistic and functional characteristics by the manner in which they are constructed.

BRIEF SUMMARY

The present disclosure relates generally to apparatus and methods for constructing ice structures. In some embodiments, an apparatus for construction of a structure from ice may include multiple tubes. In some embodiments, the tubes may be disposed in an upright or vertically-oriented position and have closed bottoms, such that each of the tubes holds liquid, such as, for example, water. In some embodiments, the tubes may be spaced apart from each other to facilitate contact of the tubes with cooling air or warming liquid.

In some embodiments, each of the tubes may have a constant inner diameter. In further detail, in some embodiments, an inner diameter of a particular tube may be constant along an entire length of the particular tube. The constant inner diameter of the particular tube may facilitate formation within the particular tube of an icicle that has a constant diameter along an entire length of the icicle.

In some embodiments, the tubes may have various lengths and/or inner diameters, depending on, for example, a desired size of icicle. In some embodiments, the tubes may have a length between approximately 30 and 36 inches, which may facilitate formation of icicles between approximately 30 and 36 inches in length, within the tubes. In some embodiments, the tubes may have inner diameters between approximately 0.5 inches and 2 inches. A particular icicle that is between approximately 30 and 36 inches, and/or has an inner diameter between approximately 0.5 inches and 2 inches, may provide icicle strength as well as size for construction of detailed or ornate ice structures. The particular icicle that is between 30 and 36 inches may also be broken in half to provide smaller icicles having strength and size for construction of detailed or ornate ice structures.

In some embodiments, each of the tubes may include a top and a bottom and a lumen extending therebetween. In some embodiments, the tubes may be constructed of any number of materials. In some embodiments, the tubes or pipes may be constructed of polyethylene, high density polyethylene (HDPE), cross-linked polyethylene or cross-linked HPDE (e.g., PEX), polypropylene, polyvinyl chloride (PVC), metal, or another material.

In some embodiments, the bottoms of the tubes may be sealed or closed using any number of suitable means. For example, the bottoms of the tubes may each include a barb plug, such as, for example, a brass or plastic PEX barb plug, which may close the bottoms of the tubes and allow the tubes to hold liquid. In some embodiments, the barb plug may be secured via a crimp ring, clamp, or another suitable means.

In some embodiments, the apparatus may include a container with open sides that allows transport of the tubes as well as ready and even contact of the tubes by cooling air and/or warming liquid. In some embodiments, the container may include a frame for transport of the tubes. In some embodiments, each of the tubes may be disposed within the frame.

The frame may include any number of configurations that allow transport of the tubes and even contact of the tubes by cooling air and/or warming liquid. In some embodiments, the cooling air and/or warming liquid may fully surround each of the tubes disposed within the frame to evenly contact the tubes. In some embodiments, the frame may include one or more of the following: a base, one or more side shafts, one or more bottom rails, and one or more top rails. In some embodiments, the top rails and/or the bottom rails may be coupled with the one or more side shafts. In some embodiments, the side shafts may be spaced apart. In some embodiments, the side shafts may be coupled with the base. In some embodiments, the side shafts may be vertically-oriented and/or the top rails may be horizontally-oriented. In these embodiments, the frame may include a rectangular shape. In some embodiments, the base may be configured to contact a bottom of the tubes and/or support the tubes. In some embodiments, the base may be planar and/or extend across a bottom of the frame.

In some embodiments, the frame may include one or more coupling elements for coupling the frame to a crane or other device for transport of the frame. For example, the frame may include one or more handles which may be coupled to one or more hooks extending from the crane or a connector element attached to the crane. In some embodiments, the handles may be disposed on the top rails. The coupling elements may include hooks, fasteners, or any other suitable coupling element.

In some embodiments, the apparatus may include one or more support sheets, which may include one or more holes sized and configured to secure the tubes. In some embodiments, the support sheets may be disposed within the frame. In some embodiments, the support sheets may be coupled to the frame via any number of suitable means, including, for example, screws, pins, stakes, etc. In some embodiments, a first support sheet may be disposed proximate the bottoms of the tubes and a second support sheet may be disposed towards a middle portion of the tubes. In some embodiments, the support sheets may be thin, such as, for example, 0.5 inches or less, so as not to impede contact of the tubes by cooling air and/or warming liquid. In some embodiments, a particular support sheet may be coupled with the base or one or more intermediate rails of the frame to secure the particular support sheet.

In some embodiments, a method of constructing a structure from ice may include placing the tubes in a freezer until liquid within the tubes freezes into icicles. In some embodiments, the method may include transporting the tubes containing the frozen liquid from the freezer to a warming bath. In some embodiments, the method may include retrieving the icicles that emerge from the tubes in response to warming the tubes within the warming bath. In some embodiments, the method may include attaching the icicles to each other to form a framework of icicles, the framework having spaces therein. In some embodiments, the method may include submerging the tubes in the liquid in the warming bath to fill the tubes with the liquid. In some embodiments, the method may include transporting the tubes containing the liquid from the warming bath to the freezer.

In some embodiments, the method may include providing one or more of the following: the tubes, the frame, and the one or support sheets. In some embodiments, the method may include coupling the support sheet to the frame. In some embodiments, the method may include placing the tubes within the holes of the support sheet to secure the tubes within the support sheet and the frame.

In some embodiments, the method may include coupling a crane or another transport device to the handles or other coupling elements of the frame to transport the tubes from the freezer to the warming bath and/or from the warming bath to the freezer.

In some embodiments, the warming bath may include a container filled with heated liquid, such as, for example, water. In some embodiments, the warming bath may incubate the frozen icicles within the tubes at a temperature above freezing over a period of time. In some embodiments, the warming bath may incubate the frozen icicles within the tubes at a constant temperature. In some embodiments, the temperature of the liquid in the warming bath may be between 32° C. and 100° C. In some embodiments, the temperature of the liquid in the warming bath may be about 60° C. to 70° C., 70° C. to 80° C., 80° C. to 90° C., or 90° C. to 100° C. In some embodiments, the container of the warming bath may include a lid, which may be insulated.

In some embodiments, the freezer may be a temperature to freeze the liquid within the tubes or less than 32° C. In some embodiments, first and second ends of the freezer may be entirely open or partially open. In some embodiments, the first and second ends of the freezer may include one or more fans such that ambient air is circulated through the freezer, which may speed freezing of the liquid in the tubes.

In some embodiments, the method may include providing a welded wire structure and delivering water to the welded wire structure at a temperature and flow rate designed to permit growth of the icicles on the welded wire structure in a low-temperature environment. In some embodiments, the welded wire structure may be horizontally oriented and/or disposed on a support structure to elevate the welded wire structure. In some embodiments, icicles harvested from the welded wire structure and/or the apparatus may be harvested and used to construct an ice structure using any of the methods described in U.S. Pat. No. 8,511,042, filed Jan. 10, 2011, which is hereby incorporated by reference.

This summary is provided to introduce a selection of concepts in a simplified form that are further described below in the Detailed Description. This Summary is not intended to identify key features or essential features of the claimed subject matter.

BRIEF DESCRIPTION OF THE DRAWINGS

Understanding that these drawings depict only typical embodiments of the invention and are not therefore to be considered limiting of its scope, the invention will be described and explained with additional specificity and detail through the use of the accompanying drawings in which.

DETAILED DESCRIPTION

Figure 1:
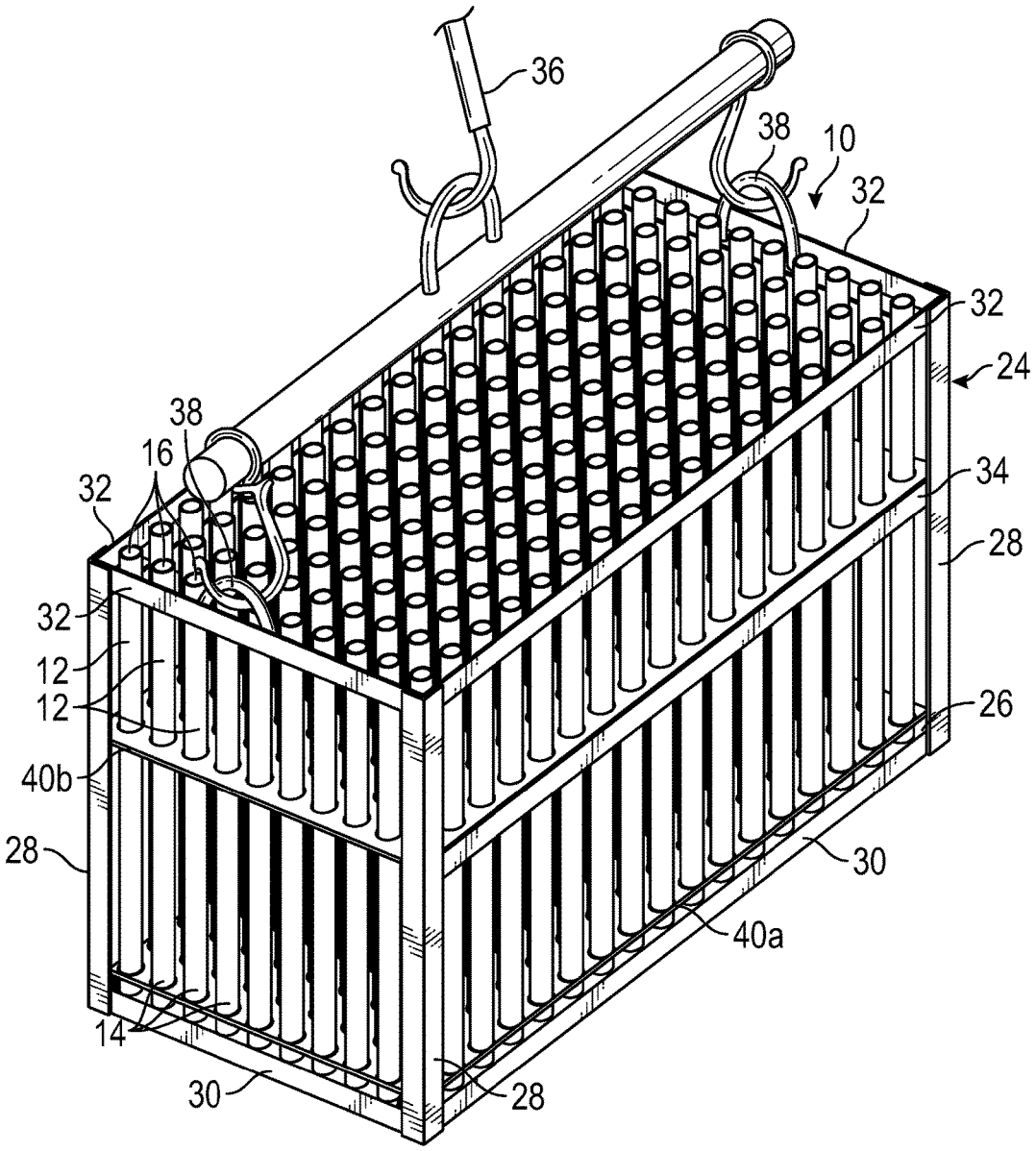
FIG. 1 is an upper perspective view of an example apparatus for construction of a structure from ice.

The present disclosure relates generally to apparatus and methods for constructing ice structures. FIG. 1 is an upper perspective view of an example apparatus 10 for construction of a structure from ice, according to some embodiments. In some embodiments, the apparatus 10 may include multiple tubes 12. In some embodiments, the tubes 12 may be disposed in an upright or vertically-oriented position and have closed bottoms 14, such that each of the tubes 12 holds liquid, such as, for example, water. In some embodiments, the tubes 12 may be spaced apart from each other to facilitate contact of the tubes 12 with cooling air or warming air/liquid.

In some embodiments, each of the tubes 12 may have a constant inner diameter. In further detail, in some embodiments, an inner diameter of a particular tube 12 may be constant along an entire length of the particular tube 12. The constant inner diameter of the particular tube 12 may facilitate formation within the particular tube 12 of an icicle that has a constant diameter along an entire length of the icicle.

In some embodiments, the tubes 12 may have various lengths and/or inner diameters, depending on, for example, a desired size of icicle. In some embodiments, the tubes 12 may be between approximately 30 and 36 inches, which may facilitate formation of icicles between approximately 30 and 36 inches in length, within the tubes 12. In some embodiments, the tubes 12 may have inner diameters between approximately 0.5 inches and 2 inches. A particular icicle that is between approximately 30 and 36 inches, and/or has an inner diameter between approximately 0.5 inches and 2 inches, may provide icicle strength as well as size for construction of detailed or ornate ice structures. The particular icicle that is between 30 and 36 inches may also be broken in half to provide smaller icicles having strength and size for construction of detailed or ornate ice structures.

In some embodiments, each of the tubes 12 may include a top 16 and a bottom 14 and a lumen extending therebetween. In some embodiments, the tubes 12 may be constructed of any number of materials. In some embodiments, the tubes 12 or pipes may be constructed of polyethylene, high density polyethylene (HDPE), cross-linked polyethylene or cross-linked HPDE (e.g., PEX), polypropylene, polyvinyl chloride (PVC), metal, or another material.

Figure 2:
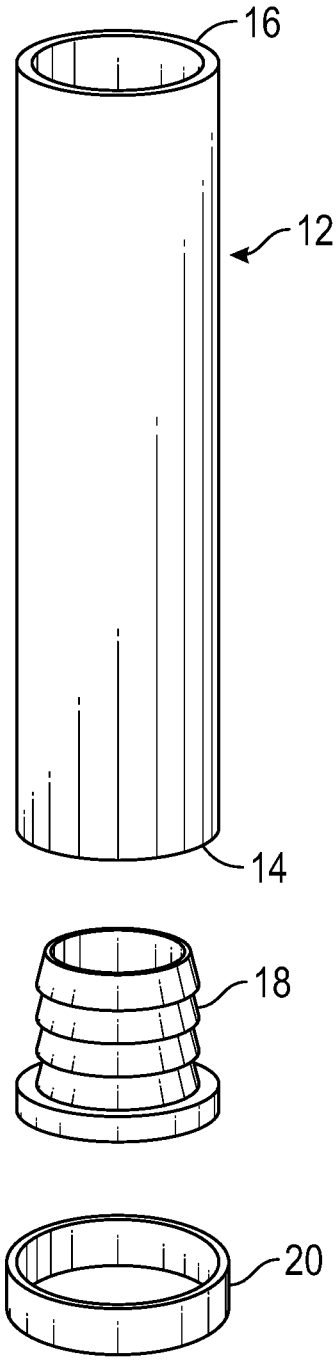
FIG. 2 is a exploded view of an example tube of the apparatus of FIG. 1, according to some embodiments.

Referring now to FIG. 2, in some embodiments, the bottoms 14 of the tubes 12 may be sealed or closed using any number of suitable means. For example, the bottoms 14 may each include a barb plug 18, such as, for example, a brass or plastic PEX barb plug, which may close the bottoms 14 and allow the tubes 12 to hold liquid. In some embodiments, the barb plug 18 may be secured via a crimp ring 20, clamp, or another suitable means. In some embodiments, the tops 16 of the tubes 12 may be open such that icicles within the tubes 12 may emerge from the tops 16 when the tubes 12 are placed in a warming bath or subjected to non-freezing air. In some embodiments, icicles harvested from the apparatus 10 may be harvested and used to construct an ice structure using any of the methods described in U.S. Pat. No. 8,511,042, filed Jan. 10, 2011, which is hereby incorporated by reference. In some embodiments, the open tops 16 may allow liquid to readily flow into the tops 16 from the warming bath to refill the tubes 12 after the icicles are removed from the tubes 12.

Referring back to FIG. 1, in some embodiments, the apparatus 10 may include a container with open sides that allows transport of the tubes 12 as well as ready and even contact of the tubes 12 by cooling air and/or warming liquid. In some embodiments, the container 22 may include a frame 24 for transport of the tubes 12. In some embodiments, each of the tubes 12 may be disposed within the frame 24.

The frame 24 may include any number of configurations that allow transport of the tubes 12 and even contact of the tubes 12 by cooling air and/or warming liquid. In some embodiments, the cooling air and/or warming liquid may fully surround each of the tubes 12 disposed within the frame 24 to evenly contact the tubes 12. In some embodiments, the frame 24 may include one or more of the following: a base 26, one or more side shafts 28, one or more bottom rails 30, and one or more top rails 32.

In some embodiments, the top rails 32 and/or the bottom rails 30 may be coupled with the one or more side shafts 28. In some embodiments, the side shafts 28 may be spaced apart. In some embodiments, the side shafts 28 may be coupled with the base 26. In some embodiments, the side shafts 28 may be vertically-oriented and/or the top rails 32 may be horizontally-oriented. In these embodiments, the frame 24 may include a rectangular shape. In some embodiments, the base 26 may be configured to contact a bottom 14 of the tubes 12 and/or support the tubes 12. In some embodiments, the base 26 may be planar and/or extend across a bottom of the frame 24.

In some embodiments, the frame 24 may include one or more coupling elements for coupling the frame 24 to a crane 36 or other device for transport of the frame 24. For example, the frame 24 may include one or more handles 38 which may be coupled to one or more hooks extending from the crane 36 or a connector element attached to the crane 36. In some embodiments, the handles 38 may be disposed on the top rails 32 or another suitable location. The coupling elements of the frame 24 may include hooks, fasteners, or any other suitable coupling element.

Figure 3:
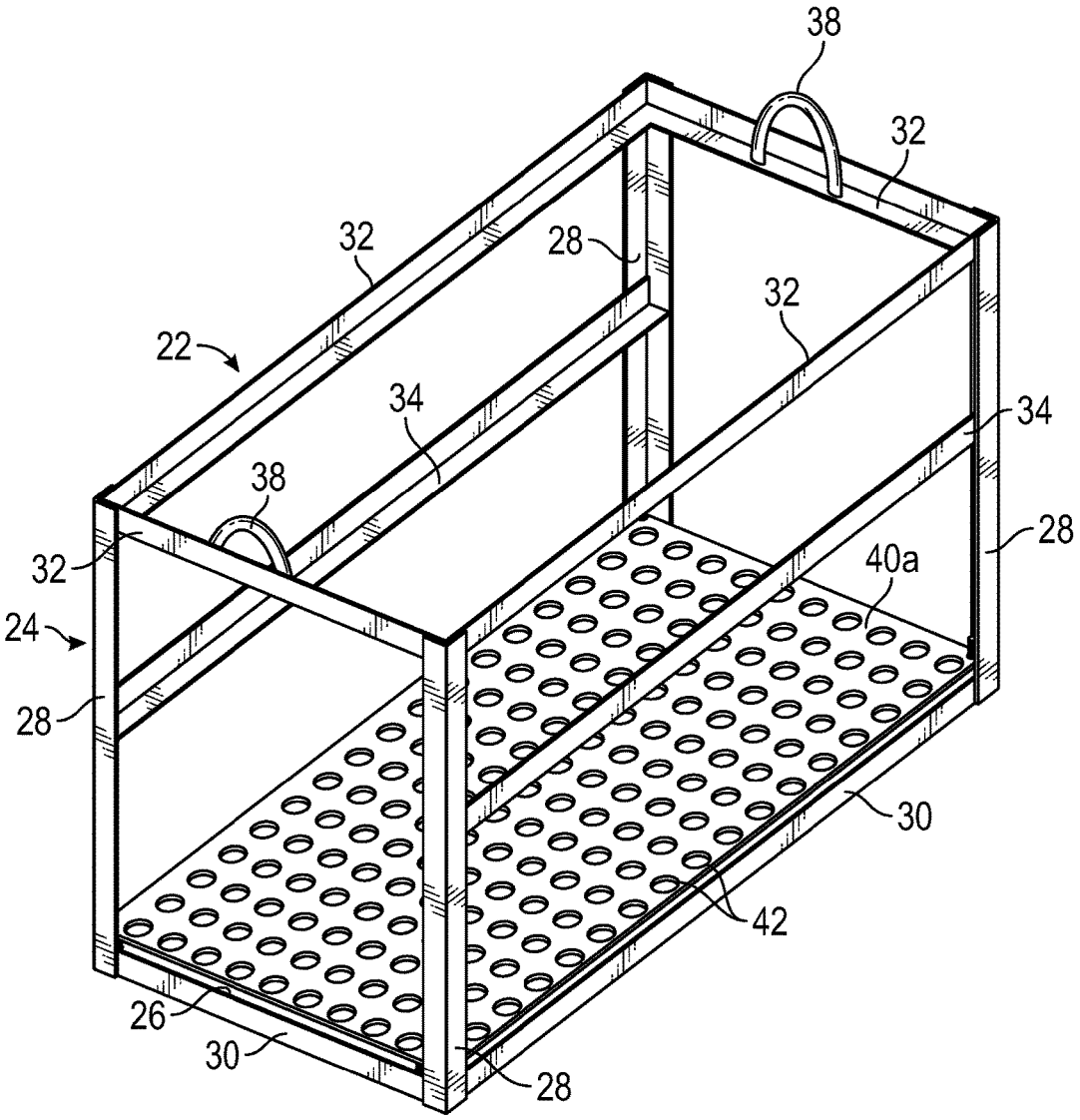
FIG. 3 is an upper perspective view of an example frame and example support sheet of the apparatus of FIG. 1, according to some embodiments.

In some embodiments, the apparatus 10 may include one or more support sheets 40. Referring now to FIG. 3, the support sheets 40 may include one or more holes 42 sized and configured to secure the tubes 12. In some embodiments, the support sheets may be disposed within the frame 24 of the container 22. In some embodiments, the support sheets 40 may be coupled to the frame via any number of suitable means, including, for example, screws, pins, stakes, etc. In some embodiments, a first support sheet **40*a* may be disposed proximate the bottoms of the tubes and a second support sheet 40*b* may be disposed towards a middle portion of the tubes, as illustrated in FIG. 1. In some embodiments, the support sheets 40 may be thin, such as, for example, 0.5 inches or less, so as not to impede contact of the tubes 12 by cooling air and/or warming liquid. In some embodiments, a particular support sheet 40 may be coupled with the frame 24 to secure the particular support sheet. For example, a particular support sheet 40 may be coupled with the base 26 or one or more intermediate rails 34 of the frame 24 to secure the particular support sheet 40**.

Figure 4:
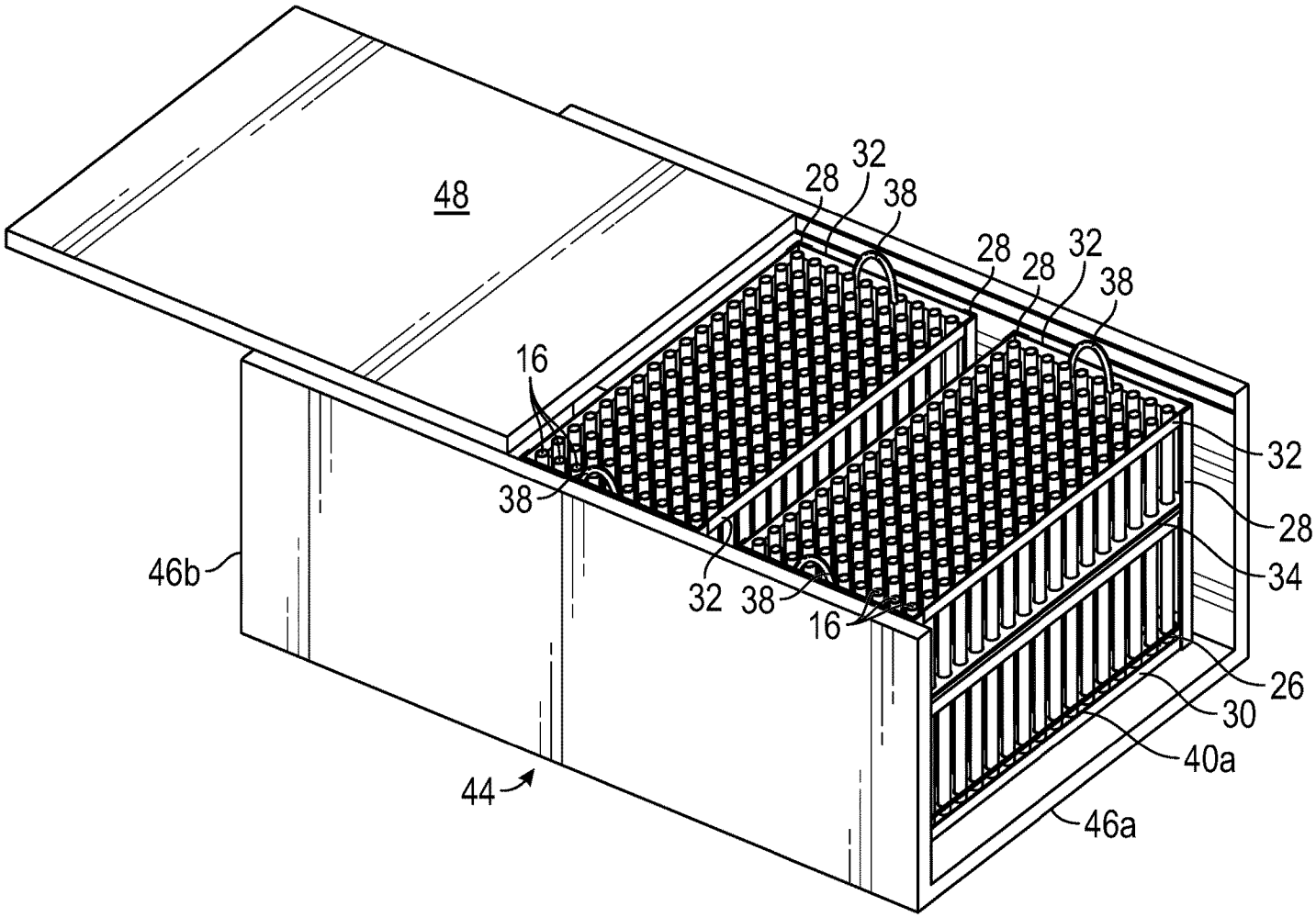
FIG. 4 is an upper perspective view of multiple example apparatus disposed in an example freezer, according to some embodiments.

Referring now to FIG. 4, in some embodiments, the tubes 12 may be filled with liquid and placed in a freezer 44. In some embodiments, the freezer 44 may be a temperature to freeze the liquid within the tubes or less than 32° C. In some embodiments, first and second ends **46*a*, 46*b* of the freezer 44 may be entirely open, as illustrated in FIG. 4, or partially open. In some embodiments, the first and second ends 46*a*, 46*b* may include one or more fans such that ambient air is circulated through the freezer 44, which may speed freezing of the liquid in the tubes. In some embodiments, the freezer 44 may include a lid 48, which is illustrated in an open position in FIG. 4. Alternatively, the apparatus 10** may be placed in any location where the temperature is below freezing (e.g., outside) to cause liquid within the tubes to freeze.

Figure 5B:
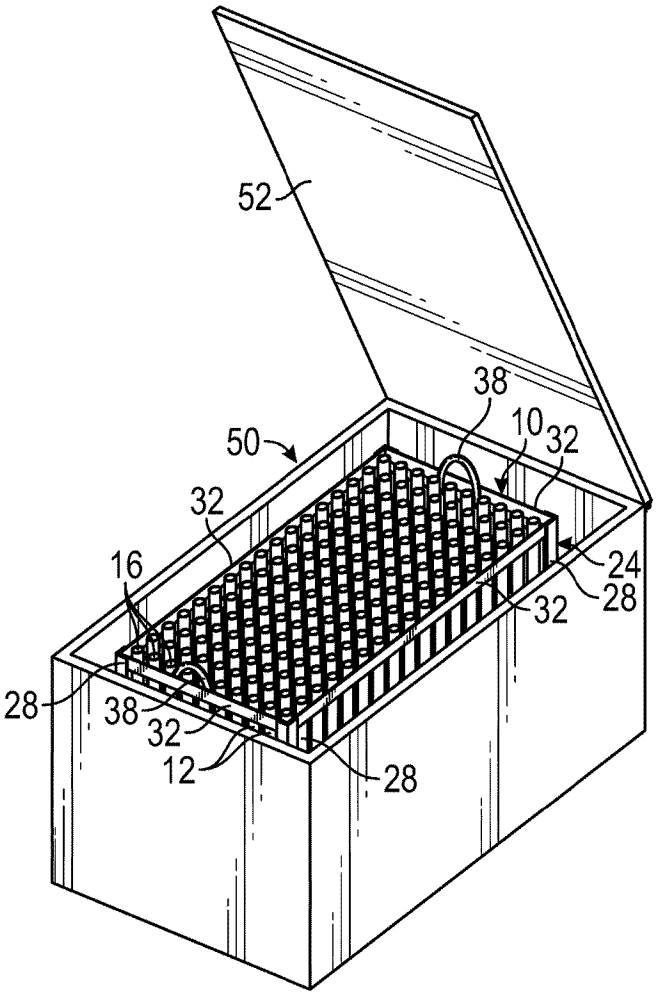
FIG. 5B is an upper perspective view of the apparatus of FIG. 5A disposed within an example warming bath, according to some embodiments.
Figure 5A:
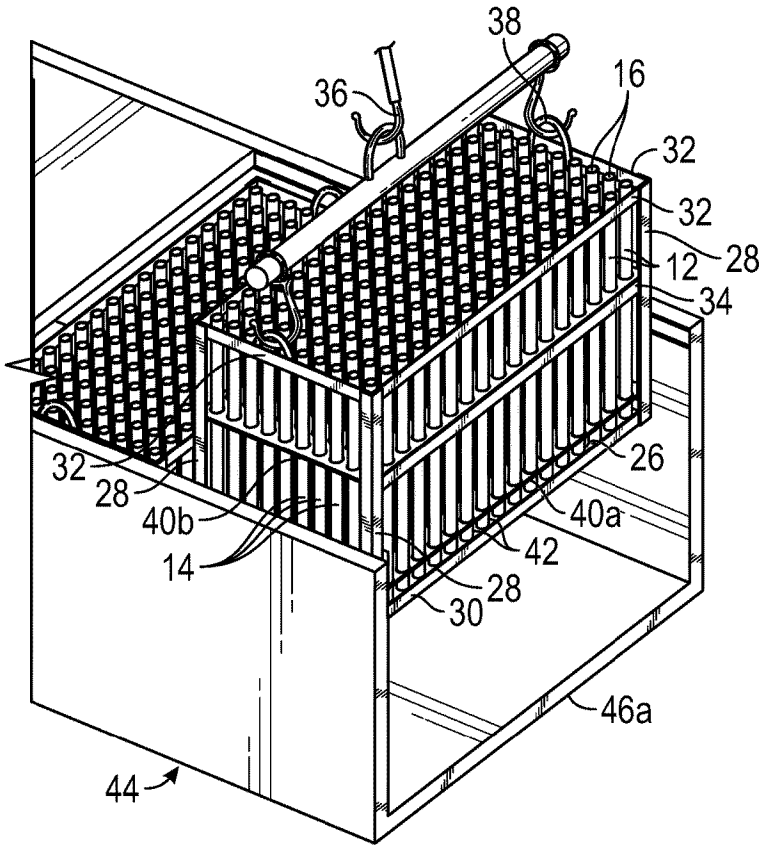
FIG. 5A is an upper perspective view of one of the apparatus of FIG. 4 being removed from the freezer, according to some embodiments.

Referring now to FIGS. 5A-5B, in some embodiments, a warming bath 50 may include a container filled with heated liquid, such as, for example, water. In some embodiments, the warming bath 50 may incubate the frozen icicles within the tubes 12 at a temperature above freezing over a period of time. In some embodiments, the warming bath 50 may incubate the frozen icicles within the tubes 12 at a constant temperature. In some embodiments, the temperature of the liquid in the warming bath 50 may be between 32° C. and 100° C. In some embodiments, the temperature of the liquid in the warming bath 50 may be about 60° C. to 70° C., 70° C. to 80° C., 80° C. to 90° C., or 90° C. to 100° C. In some embodiments, the container of the warming bath 50 may include a lid 52, which may be insulated.

Figure 6:
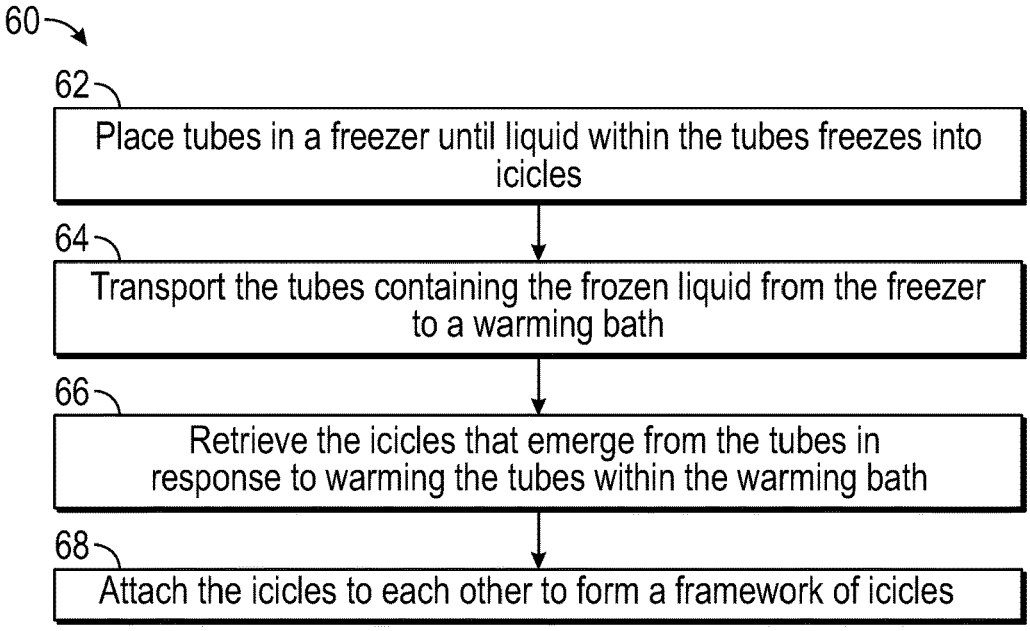
FIG. 6 is flow diagram of an example method of constructing a structure from ice, according to some embodiments.

Referring now to FIG. 6, in some embodiments, a method 60 of constructing a structure from ice may begin at block 62. At block 62, the tubes 12 may be placed in the freezer 44 (or another freezing location) until liquid within the tubes 12 freezes into icicles. Block 62 may be followed by block 64.

At block 64, the tubes 12 containing the frozen liquid may be transported from the freezer 44 to the warming bath 50 (or to a location where the tubes will be subjected to non-freezing air). Block 64 may be followed by block 66.

At block 66, the icicles that emerge from the tubes 12 in response to warming the tubes 12 within the warming bath 50 may be retrieved. In some embodiments, a portion of a particular icicle may emerge from the top 16 a particular tube 12 automatically in response to the tube 12 being placed in the warming bath 50 for a particular period of time. In some embodiments, the portion of the particular icicle may be manually pulled to remove the icicle from the particular tube 12. In some embodiments, an entirety of a particular icicle may emerge from the a particular tube 12 automatically in response to the tube 12 being placed in the warming bath 50 for the period of time and/or may float in the warming bath 50 prior to retrieval. Block 66 may be followed by block 68.

At block 68, the icicles may be attached to each other to form a framework of icicles. Alternatively, the icicles may be attached to existing ice structures or other structures or materials. Although illustrated as discrete blocks, various blocks may be divided into additional blocks, combined into fewer blocks, or eliminated, depending on the desired implementation. For example, the method 60 may include submerging the tubes 12 in the liquid in the warming bath 50 to fill the tubes 12 with the liquid. In some embodiments, the method 60 may include transporting the tubes 12 containing the liquid from the warming bath 50 to the freezer 44.

In some embodiments, the method 60 may include providing one or more of the following: the tubes 12, the frame 24, and the one or support sheets 40. In some embodiments, the method 60 may include coupling the support sheets 40 to the frame 24. In some embodiments, the method 60 may include placing the tubes 12 within the holes 42 of the support sheets 40 to secure the tubes 12 within the support sheets 40 and the frame 24.

In some embodiments, the method 60 may include coupling a crane 36 or another transport device to the handles 38 or other coupling elements of the frame 24 to transport the tubes 12 from the freezer 44 to the warming bath 50 and/or from the warming bath 50 to the freezer 44.

Figure 7:
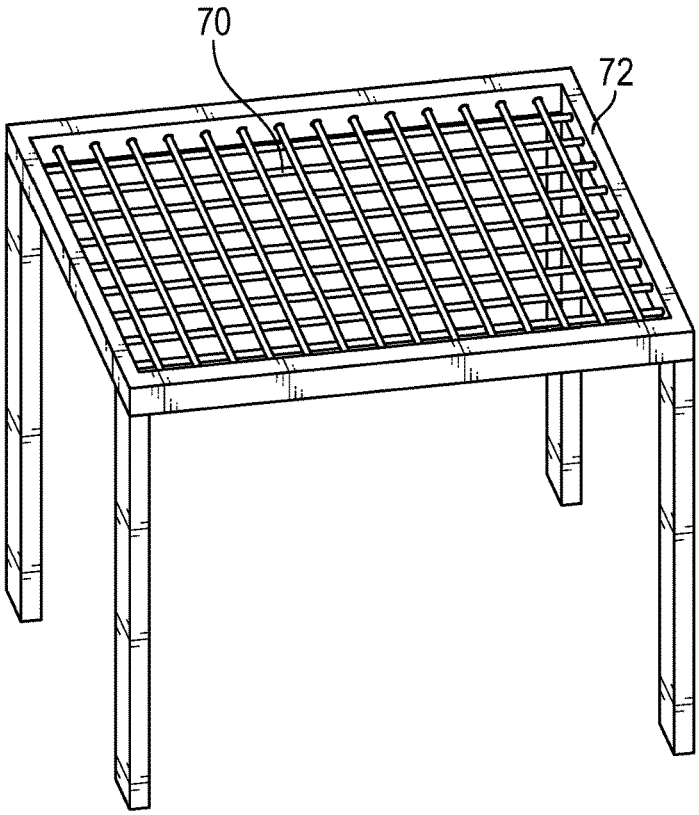
FIG. 7 is an upper perspective view of an example welded wire structure, according to some embodiments.

Referring now to FIG. 7, a welded wire structure 70 may be horizontally-oriented and/or disposed on a support structure 72. The term "welded wire" refers to the fact that the wires are welded together at each intersection. These wires may be overlapped (as shown in FIG. 7) or weaved. Support structure 72 can include vertically oriented legs that elevate the welded wire structure 70 above the ground to allow icicles to form on and hang from the welded wire structure 70 as water is sprayed overtop the structure (e.g., by using a sprinkler). In some embodiments, wires of the welded wire structure 70 may overlap to form squares or rectangles, which may provide improved formation of the icicles.

Figure 8:
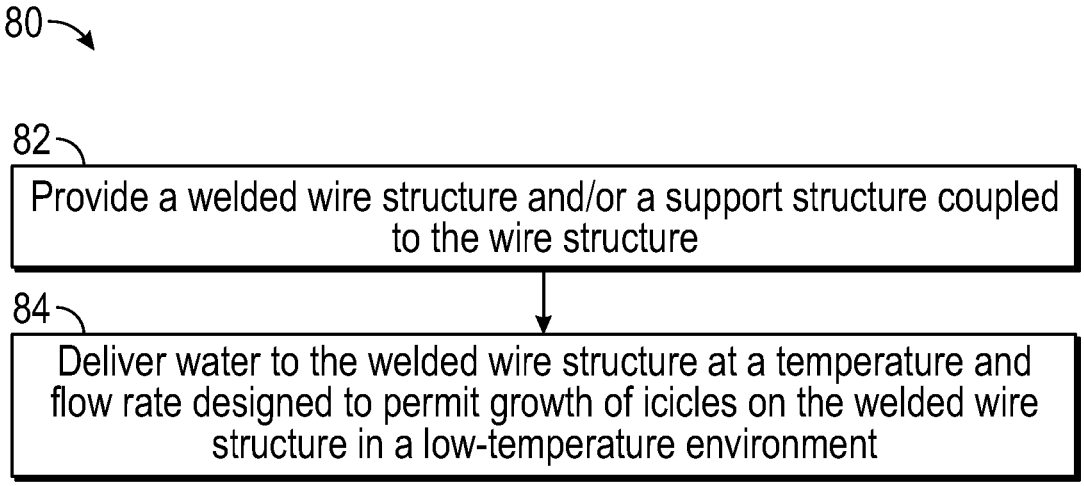
FIG. 8 is flow diagram of another example method of constructing a structure from ice, according to some embodiments.

Referring now to FIG. 8, in some embodiments, a method 80 of constructing a structure from ice may begin at block 82. At block 82, the welded wire structure 70 and/or the support structure 72, which may be coupled to the welded wire structure 70, may be provided. Block 82 may be followed by block 84.

At block 84, a liquid, such as, for example, water, may be delivered to the welded wire structure 70 at a temperature and flow rate designed to permit growth of the icicles on the welded wire structure 70 in a low-temperature environment. For example, a sprinkler or sprinkler system can be employed to spray water over the welded wire structure 70. In some embodiments, the welded wire structure 70 may be horizontally oriented and/or disposed on the support structure 72 to elevate the welded wire structure 70. In some embodiments, the icicles harvested from the welded wire structure 70 may be used to construct an ice structure using any of the methods described in U.S. Pat. No. 8,511,042, filed Jan. 10, 2011, which is hereby incorporated by reference.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description.

What is claimed:

1. A method of constructing a structure from ice, comprising:

placing a plurality of tubes in a freezing environment until liquid within the plurality of tubes freezes into icicles;

transporting the plurality of tubes containing the frozen liquid to a warming bath;

retrieving the icicles that emerge from the plurality of tubes in response to the plurality of tubes being warmed within the warming bath;

maintaining the plurality of tubes submerged in the warming bath after the icicles have emerged from the plurality of tubes to fill the plurality of tubes with the liquid; and transporting the plurality of tubes containing the liquid from the warming bath to the freezing environment.

2. The method of claim 1, wherein each of the plurality of tubes has a constant inner diameter to thereby cause the icicles to have a constant outer diameter.

3. The method of claim 1, wherein the plurality of tubes are contained in a frame that comprises a base configured to contact a closed bottom of the plurality of tubes to support the plurality of tubes.

4. The method of claim 1, wherein the plurality of tubes are contained in a frame that comprises one or more side shafts and one or more top rails coupled with the one or more side shafts.

5. The method of claim 1, wherein the plurality of tubes are contained in a frame that comprises one or more coupling elements for coupling the frame to a crane for transport of the frame between the freezing environment and the warming bath.

6. The method of claim 1, wherein the plurality of tubes are contained in a frame that comprises one or more support sheets disposed within the frame, each support sheet comprising a plurality of holes sized and configured to secure the plurality of tubes in an upright position.

7. The method of claim 6, wherein the support sheet is coupled to the frame.

8. The method of claim 1, wherein the plurality of tubes are spaced apart from each other to facilitate contact with cooling air when the plurality of tubes are positioned in the freezing environment or warming liquid when the plurality of tubes are positioned in the warming bath.

9. The method of claim 1, wherein a length of each of the plurality of tubes is between 30 and 36 inches.

10. The method of claim 1, wherein the freezing environment comprises one of:

open space; or an enclosed area having open ends through which air is circulated.

11. The method of claim 1, wherein an inner diameter of each of the plurality of tubes is between ½ inch and 2 inches.

12. The method of claim 1, further comprising attaching the icicles to each other or to an existing ice structure to form a framework of icicles, the framework having spaces therein.

13. The method of claim 1, wherein the freezing environment comprises open space.

14. The method of claim 1, wherein each of the plurality of tubes has a length of 36 inches.

15. The method of claim 1, wherein transporting the plurality of tubes comprises coupling a crane to a frame that houses the plurality of tubes.

16. The method of claim 1, wherein the freezing environment comprises a freezer having first and second ends that are open.

17. The method of claim 16, further comprising:

circulating air through the freezer while the plurality of tubes are placed therein.

18. The method of claim 1, wherein the plurality of tubes are spaced within a frame to thereby allow the liquid to contact and surround the plurality of tubes in response to the frame and plurality of tubes being inserted into the warming bath.

19. A method of constructing a structure from ice, comprising:

placing a frame containing a plurality of tubes in a freezing environment until liquid within the plurality of tubes freezes into icicles;

after the liquid within the plurality of tubes freezes into icicles, transporting the frame containing the plurality of tubes to a warming bath;

retrieving the icicles that emerge from the plurality of tubes in response to the plurality of tubes being warmed within the warming bath;

maintaining the plurality of tubes submerged in the warming bath after the icicles have emerged from the plurality of tubes to fill the plurality of tubes with the liquid;

transporting the plurality of tubes containing the liquid from the warming bath to the freezing environment; and employing the icicles to construct a structure.

20. A method of constructing a structure from ice, comprising:

placing a frame containing a plurality of tubes in a freezing environment until water within the plurality of tubes freezes into icicles;

after the water within the plurality of tubes freezes into icicles, transporting the frame containing the plurality of tubes to a warming bath;

retrieving the icicles that emerge from the plurality of tubes in response to the plurality of tubes being warmed within the warming bath;

maintaining the plurality of tubes submerged in the warming bath after the icicles have emerged from the plurality of tubes to fill the plurality of tubes with water from the warming bath; and transporting the plurality of tubes containing the water from the warming bath to the freezing environment.

* * * * *